US009644298B2

(12) United States Patent
Mazoyer et al.

(10) Patent No.: US 9,644,298 B2
(45) Date of Patent: May 9, 2017

(54) SEALING HEAD FOR MACHINES FOR HEAT TREATING THREADS

(71) Applicant: Superba, Mulhouse (FR)

(72) Inventors: Michel Mazoyer, Pfastatt (FR); Antoine Chochol, Kingersheim (FR)

(73) Assignee: Superba, Mulhouse (FR)

( * ) Notice: Subject to any disclaimer, the term of this patent is extended or adjusted under 35 U.S.C. 154(b) by 0 days.

(21) Appl. No.: 14/658,778

(22) Filed: Mar. 16, 2015

(65) Prior Publication Data

US 2015/0184322 A1 Jul. 2, 2015

Related U.S. Application Data

(62) Division of application No. 11/501,440, filed on Aug. 9, 2006, now abandoned.

(60) Provisional application No. 60/719,003, filed on Sep. 21, 2005.

(30) Foreign Application Priority Data

Sep. 1, 2005 (FR) ..... 05 08987

(51) Int. Cl.
*D06B 23/18* (2006.01)
*D02J 13/00* (2006.01)

(52) U.S. Cl.
CPC ..... *D06B 23/18* (2013.01); *D02J 13/001* (2013.01); *D02J 13/006* (2013.01)

(58) Field of Classification Search
CPC ..... D06B 23/18; D02J 13/001; D02J 13/005; F16J 3/06
See application file for complete search history.

(56) References Cited

U.S. PATENT DOCUMENTS 3,319,532 A * 5/1967 Pridham, Jr. ..... F15B 15/10 92/34
3,920,287 A * 11/1975 Jamin ..... F16J 15/168 384/15
4,136,536 A * 1/1979 Gorodissky ..... D06B 23/18 34/242

(Continued)

FOREIGN PATENT DOCUMENTS

FR 2629106 9/1998

OTHER PUBLICATIONS

French International Preliminary Examination for French Application No. 0508987, mailed Jun. 2, 2006 (6 pages).

(Continued)

*Primary Examiner* — John Goff
(74) *Attorney, Agent, or Firm* — Kilpatrick Townsend & Stockton LLP; Dean W. Russell; Matthew T. Kitces

(57) ABSTRACT

The present invention relates to a sealing head for machines for heat treating threads, comprising a frame fixed to a pressurized chamber through which a conveyor belt passes, a pair of horizontal rollers placed on top of each other and pressed against the opposite faces of the conveyor belt and of seals to form a sealed closure between the rollers and the frame, at least one of the horizontal rollers and the seals being connected to the corresponding movement actuators. Sealing head characterized in that the actuators of the horizontal roller or rollers and the seals between the rollers and the frame are in the form of pneumatic actuators without pistons, namely of the balloon or bellows type.

8 Claims, 3 Drawing Sheets

(56) References Cited

U.S. PATENT DOCUMENTS

| | | | | |
|---|---|---|---|---|
| 4,422,368 | A * | 12/1983 | Frey | F16J 3/06 92/105 |
| 4,652,148 | A | 3/1987 | Olasz | |
| 4,949,558 | A | 8/1990 | Enderlin | |
| 5,074,130 | A | 12/1991 | Enderlin | |
| 5,181,452 | A | 1/1993 | Immega | |
| 6,484,601 | B1 | 11/2002 | Arrichiello | |
| 2002/0178936 | A1 | 12/2002 | Williams | |
| 2007/0044428 | A1 * | 3/2007 | Mazoyer | D02J 13/006 53/137.2 |

OTHER PUBLICATIONS

Restriction Requirement for U.S. Appl. No. 11/501,440, mailed Mar. 26, 2010.
Response to Restriction Requirement for U.S. Appl. No. 11/501,440, filed May 5, 2010.
Non-Final Office Action for U.S. Appl. No. 11/501,440, mailed Jul. 2, 2010.
Amendment under 37 C.F.R. § 1.111 for U.S. Appl. No. 11/501,440, filed Sep. 13, 2010.
Final Office Action for U.S. Appl. No. 11/501,440, mailed Nov. 17, 2010.
Amendment under 37 C.F.R. § 1.111 for U.S. Appl. No. 11/501,440, filed Feb. 10, 2011.
Interview Summary for U.S. Appl. No. 11/501,440, mailed Feb. 11, 2011.
Advisory Action for U.S. Appl. No. 11/501,440, mailed Feb. 24, 2011.
Amendment and Response to Final Office Action and Rule 132 Affidavit of Mr. Philippe Massotte for U.S. Appl. No. 11/501,440, filed Jun. 13, 2011.
Non-Final Office Action for U.S. Appl. No. 11/501,440, mailed Jul. 6, 2011.
Applicant Initiated Interview Summary for U.S. Appl. No. 11/501,440, mailed Sep. 27, 2011.
Amendment and Response to Non-Final Office Action for U.S. Appl. No. 11/501,440, filed Oct. 4, 2011.
Final Office Action for U.S. Appl. No. 11/501,440, mailed Dec. 6, 2011.
Amendment and Response to Final Office Action for U.S. Appl. No. 11/501,440, filed Feb. 3, 2012.
Advisory Action for U.S. Appl. No. 11/501,440, mailed Feb. 10, 2012.
Appeal Brief for U.S. Appl. No. 11/501,440, filed May 3, 2012.
Examiner's Answer for U.S. Appl. No. 11/501,440, mailed Jul. 23, 2012.
Decision on Appeal for U.S. Appl. No. 111/501,440, mailed Jan. 20, 2015.

* cited by examiner

SEALING HEAD FOR MACHINES FOR HEAT TREATING THREADS

CROSS-REFERENCE TO RELATED APPLICATIONS

This application is a divisional patent application of U.S. application Ser. No. 11/501,440, filed Aug. 9, 2006, now abandoned, which claims the benefit of U.S. Provisional Application No. 60/719,003, filed Sep. 21, 2005 and which claims priority to French Application No. 0508987, filed Sep. 1, 2005, each of which is incorporated herein by reference in its entirety.

BACKGROUND OF THE INVENTION

The present relates to the field of the textile industry, particularly the treatment of threads using heat treatment machines generally known as heat setting machines, and relates to a sealing head for such machines.

These heat treatment machines comprise a pressurized chamber for heat treating textile threads laid on a conveyor belt traversing said chamber, which is closed at both its ends by sealing heads each comprising a frame fixed to the pressurized chamber, a pair of horizontal rollers placed on top of each other and pressed against the opposite faces of the conveyor belt and seals to form a sealed closure between the rollers and the frame.

At present, the horizontal rollers are actuated by tightening means that allow movement of at least one of the rollers in the direction of the other and the seals are in the form, on the one hand, of an upper element and a lower element extended and resting against the generators of the two rollers and, on the other hand, of side sealing plates resting in a sliding manner against the corresponding ends of the rollers.

The seals, both horizontal and vertical, are applied by means of actuators, in the form of high-pressure hydraulic cylinders, with drilled rods or cylinder blocks for the horizontal components and high-pressure hydraulic cylinders with angle return levers, for the side sealing plates. The drilled cylinder blocks are, in fact, cylinders with several pistons and piston rods that are aligned in parallel in a single cylinder block and have a single hydraulic supply, their operation being in addition identical to that of the usual hydraulic cylinders.

These known actuators, in the form of cylinders, provide an adequate response to the problems posed, on the one hand, of application under pressure of the horizontal rollers against the conveyor belt and, on the other hand, of the seals against said rollers.

However, due to their structure in the form of high-pressure hydraulic cylinders, that is operating at a pressure of approximately 80 bar, there is a risk of hydraulic liquid leaks that could lead to said liquid flowing over the rollers and/or onto the textile material and, as a corollary, the contamination thereof. It is therefore necessary to recycle the oil. It follows that the hydraulic device for applying pressure is subject to significant heating that could lead to a stoppage of the machine and the corresponding maintenance work.

In addition, because pressure is applied by means of hydraulic fluid, which cannot be compressed, the sealing head unit has a completely rigid system for applying pressure that allows no fluctuation or variation of pressure on any of the actuators.

Finally, because of the actual structure of the present sealing heads with actuators in the form of hydraulic cylinders, the maintenance work is relatively complex and long and leads to correspondingly long machine stoppages, which reduces their productivity.

BRIEF SUMMARY OF THE INVENTION

The present invention aims to overcome these drawbacks by proposing a sealing head for machines for the heat treatment of threads that provides easy access to the components subject to wear and avoids the drawbacks relating to high-pressure hydraulic actuators.

Accordingly, the sealing head for machines for the heat treatment of threads, which comprises a frame fixed to a pressurized chamber through which a conveyor belt passes, a pair of horizontal rollers placed on top of each other that are pressed against the opposite faces of the conveyor belt and of seals to form a sealed closure between the rollers and the frame, at least one of the horizontal rollers and the seals being connected to the corresponding movement actuators, is characterized in that the actuators of the horizontal roller or rollers and the seals between the rollers and the frame are in the form of actuators without pistons, namely of the balloon or bellows type.

BRIEF DESCRIPTION OF THE DRAWINGS

The invention will be better understood with the aid of the description below which relates to a preferred embodiment given as a non-limiting example, and explained with reference to the accompanying diagrammatic drawings, in which.

DETAILED DESCRIPTION OF THE DRAWINGS

FIGS. 1 to 4 of the accompanying drawings illustrate, by way of example, a sealing head for machines for heat treating threads, comprising a frame 1 fixed to a pressurized chamber (not shown) through which a conveyor (not shown) belt passes, a pair of horizontal rollers 2 and 3 placed on top of each other which are pressed against the opposite faces of the conveyor belt and of seals 4 and 5 to form a sealed closure between the rollers 2 and 3 and the frame 1, at least one, 2, of the horizontal rollers and seals 4 and 5 being connected to the corresponding movement actuators 6 to 8.

Figure 1:
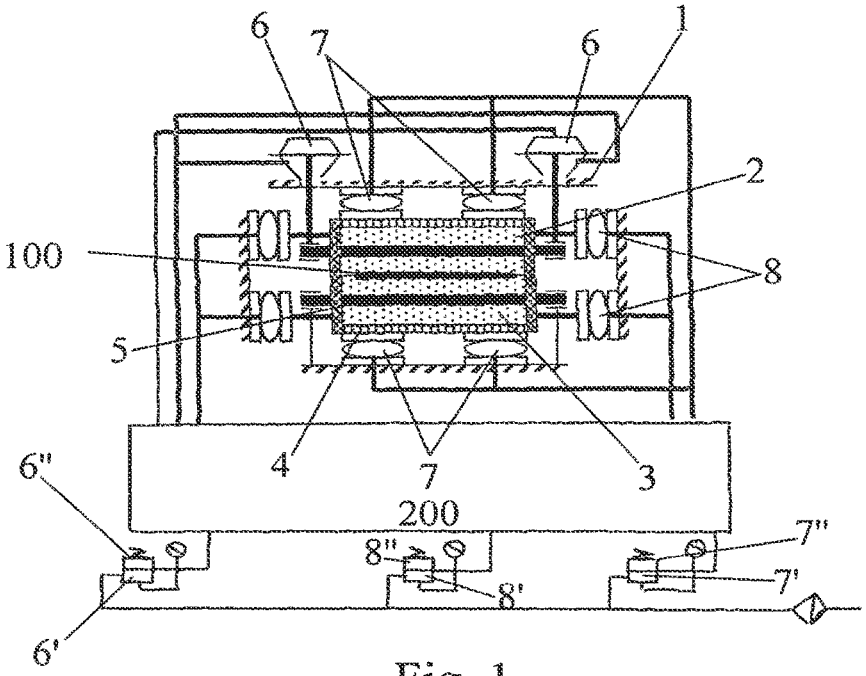
FIG. 1 is an operating diagram of a sealing head according to the invention.

According to the invention, and as shown more particularly in diagrammatic illustration in FIG. 1 of the accompanying drawings, the actuators 6 to 8 of the horizontal roller or rollers 2 and/or 3 and the seals 4 and 5 between the rollers 2 and 3 and the frame 1 are in the form of low-pressure actuators without a piston, namely of the balloon or bellows type. Preferably, these actuators 6 to 8 are actuators that operate under a maximum usage pressure of about 8 bar.

Figure 5:
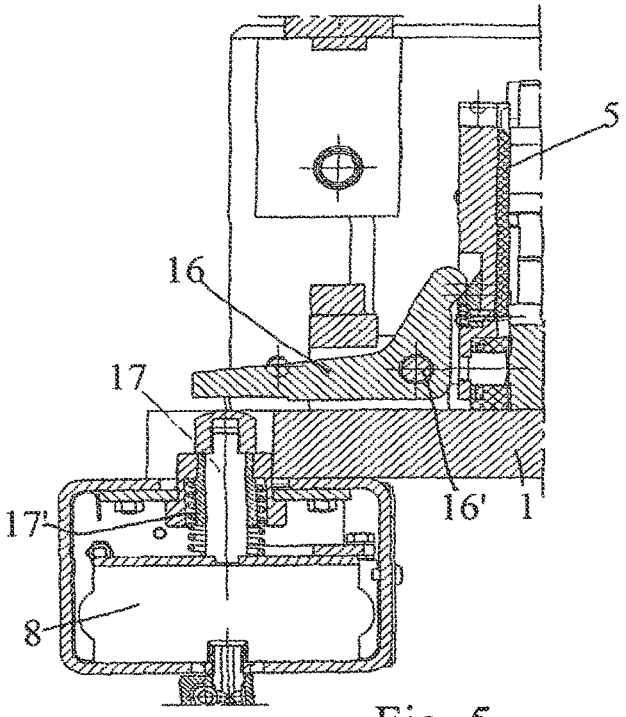
FIG. 5 is a part section, on a larger scale, along C-C of FIG. 2.

It should be stated that the illustration in FIG. 1 is diagrammatic and the arrangement of the actuators 8 for the seals 5 is symbolic only, in order to make the action of said actuators 8 perfectly clear, the positioning of such an actuator being illustrated in FIG. 5.

Figure 4:
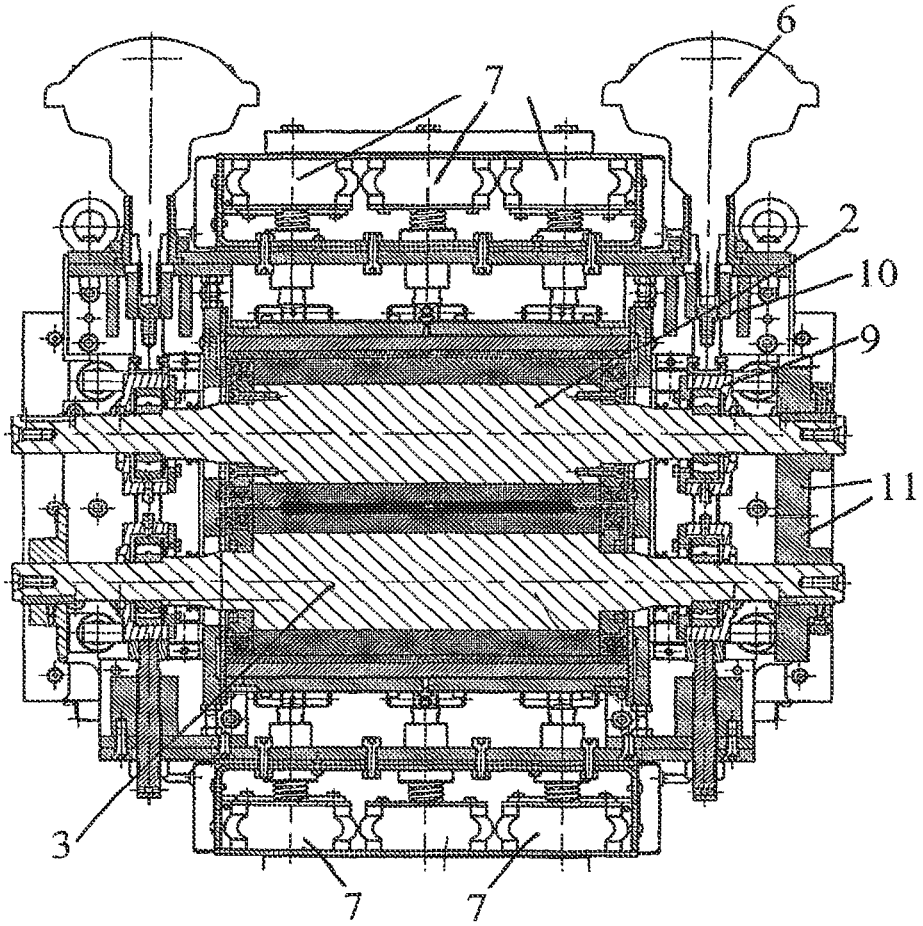
FIG. 4 is a section along B-B of FIG. 3.

The actuators 6, which are designed to apply at least one of the two horizontal rollers on the conveyor belt against the other horizontal roller 3, are advantageously dual-action diaphragm cylinders and are arranged on the frame 1, on either side of said horizontal rollers 2 and 3, and act on the driving and guiding shaft or shafts of said horizontal rollers 2 and 3, in the region of their ends, by means of sliding bearings 9 guided in the corresponding ends of the frame 1 and cooperating with the push rods 10, connected at one end to said sliding bearing 9 and connected by their other end to the corresponding diaphragm of the actuator 6 (FIG. 4).

It is also possible to produce each actuator 6 in the form of two single-action actuators of the balloon or bellows type, these two actuators each acting on either side, either of the bearing supporting the shaft of the corresponding roller, or on a movement means connected to said bearing.

Thus, it is possible to produce movement of at least one of the horizontal rollers 2 and/or 3 of the sealing head to allow, for example, replacement of the conveyor belt, and thus a slackening of the belt, possibly while completely disconnecting the driving pinions 11 from said horizontal rollers 2 and 3, then tightening said rollers using a predetermined pressure and connecting the pinions 11 ensuring their perfect functionality, even under maximum application pressure.

Figure 3:
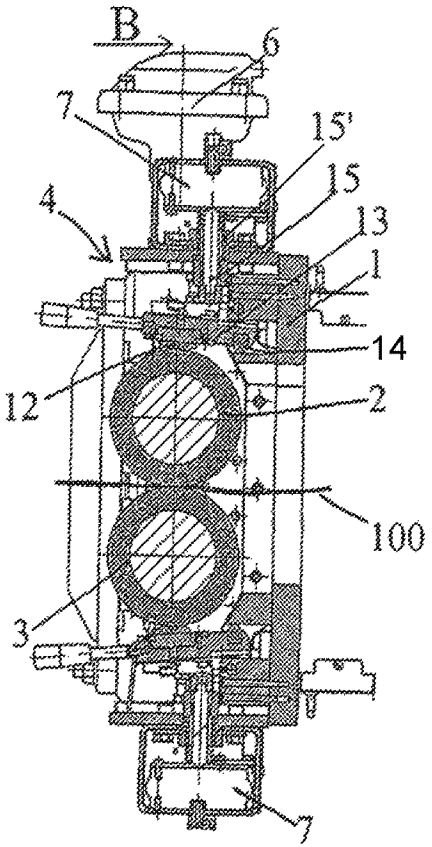
FIG. 3 is a section along A-A of FIG. 2.
Figure 2:
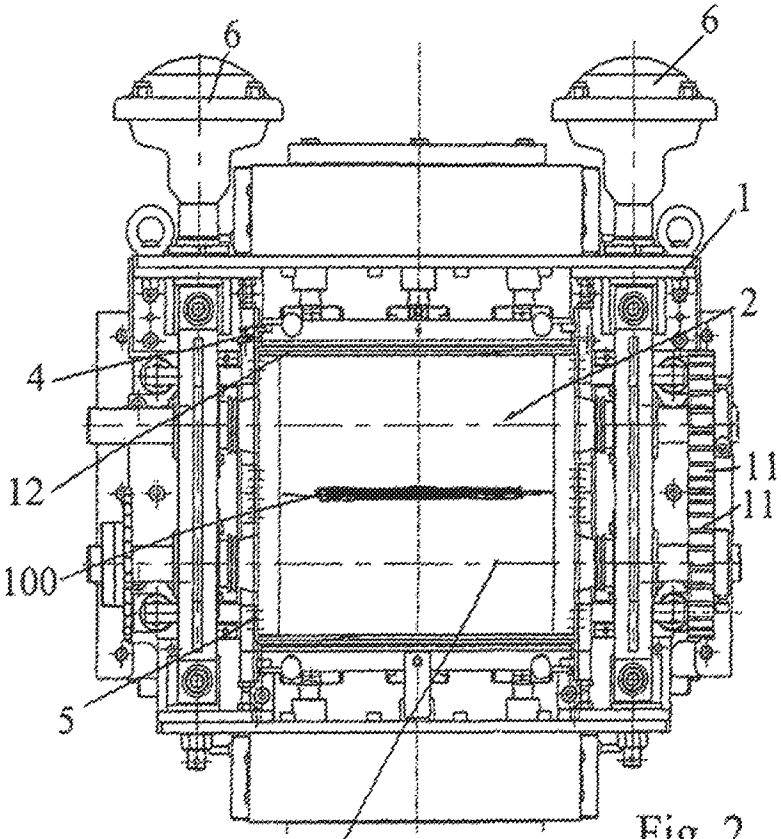
FIG. 2 is a front elevation of a preferred embodiment of the invention.

The seals 4 between the rollers 2 and 3 and the frame 1, which consist, for each roller 2 and 3 of a thin sealing sheet 12 mounted on a pivoting support 13 resting on the frame 1 by means of a longitudinal pivoting end stop 14, each co-operate with the corresponding actuator or actuators 7, in the form of balloons or bellows, by means of a load transfer rod 15, mounted on the frame 1 between the corresponding actuator 7 and the pivoting support 13 and loaded by a return spring 15' (FIG. 3). Thus, it is possible to apply the thin sealing sheet 12 on the corresponding roller 2 or 3 under a load predetermined by the supply pressure of the actuators 7, cutting the supply of said actuators 7 which has the effect of releasing the pressure on the pivoting support 13 which can thus either release the thin sealing sheet 12 from the lower horizontal roller 3 under the effect of its own weight, or be raised to be placed out of contact with the upper horizontal roller 2 by means of an operating lever 13' of said upper pivoting support 13.

The actuators 8 are advantageously balloon or bellows actuators and act on the seals 5 between the horizontal rollers 2 and 3 and the frame 1, which are in the form of sealing plates, by means of a force transfer device in the form of an elbow lever 16 pivotally mounted about a pin 16' on the frame 1 and actuated so as to pivot by means of a transmission rod 17 comprising a return spring 17'. Thus, pressurizing the bellows or balloon forming each actuator 8 has the effect of moving the transmission rod 17 in the sense of a rocking action of the elbow lever 16 about its pin 16', which leads to a corresponding transmission of the load in the direction of the corresponding plate forming the seals 5 and the application under a predetermined pressure of said plate against the ends of the rollers 2 and 3. By providing an elbow lever 16, it is possible to produce a large increase in the application load of the seals 5 by adaptation of a torque transmission ratio corresponding to the ratio of the lever arms of the elbowed lever.

In fact, as shown in FIG. 5 of the accompanying drawings, the provision of a lever arm which is longer between the pivot pin 16' and the axis of the transmission rod 17 of one of the wings of the elbow lever 16 and another which is shorter allows a mechanical increase in the load applied to the seals 5.

According to a characteristic of the invention, the actuators 6 to 8 are advantageously pneumatic actuators. Due to the compressibility of the air or gas, the use of such pneumatic actuators allows the absorption of vibrations and/or distortions. However, it is also possible to produce these actuators in the form of hydraulic oil or aqueous fluid actuators, as water or glycol.

In any event, these actuators, because of their structure with no sliding component outside their pressure chamber, are completely sealed, such that the risk of fluid leaks is eliminated. In addition, their operation at low pressure prevents any risk of overheating, which could damage their operation.

These actuators 6 to 8 are advantageously commercially available pliable bellows cylinders known under the name "Pneuride", having dimensions of 6"×1" and available, in particular, under commercial references PM31061 from NORGREN, 9109004 from PARKER or SP1536 from WEFORMA, and commercially available pliable bellows cylinders known under the name "Pneuride", having dimensions of 4.5"×1" and available, in particular, under commercial references PM31041 from NORGREN, 9109400 from PARKER or SP2334 from WEFORMA, and also dual-action diaphragm cylinders available, in particular, under commercial references KHGS from CEF and COD600-50 from REXROTH PARKER-BOSCH.

With pliable cylinders of this type, for a given cylinder height, the force developed is proportional to the fluid pressure and, when the sealing head is clamped in the closed position, said cylinders act as pneumatic springs and the vibration insulation complies with the law:

$$I=1-[1/(Fe/Fn)^2-1]$$

in which:

I=insulation rate

Fe=excitation frequency in hertz

Fn=natural frequency of the bellows in hertz

Depending on the conditions of use, the balloons forming the actuators 6 to 8 may be made from natural or synthetic rubber of the butyl, epichlorine or nitrile type, these materials optionally being combined with a fabric insert.

If the fluid used is incompressible, the damping effect will be limited to the deformability of the balloon, which is generally defined for a maximum use pressure of 8 bars and an operating temperature of between −40° C. and +130° C., depending on the material from which the balloon is made. It is also possible to add to this material anti-UV agents intended to improve the ozone resistance or to provide specific protection at the surface of the bellows.

The actuators 6 to 8 thus act simultaneously as actuators and as pneumatic springs and, while being compact in their construction, provide high power within a low overall size and also a high degree of reliability and substantial operational flexibility. Furthermore, these actuators do not require any maintenance, are resistant to aggressive environments and have a very long service life.

In addition, as the flanges of these actuators are guided by a pin, the bellows are protected from harmful lateral vibrations, even in the event of unsymmetrical wear to a sealing sheet or plate.

Moreover, since the diaphragms are, as is known, protected against the projections of chemical agents by a stainless steel screen allowing optimal control of the course of the bellows, this protection is also effective against tearing, scratching, notching, particle projections and against shocks, as well as against accidental excess fluid pressure, the shield preventing dislodgment.

According to another characteristic of the invention, the different actuators 6 to 8 are each provided with a drain valve 6' to 8' and are advantageously controlled automatically, either by means of a programmable controller 200, or by means of a pneumatic controller using elements of pneumatic logic, standard logic or electropneumatic logic acting on the regulating valves 6" to 8" arranged in the supply circuit of the actuators 6 to 8. Pressurized fluid for actuating each of the balloon or bellows type actuators can be supplied by a common pressure supply, wherein, each of the plurality of regulating valves is coupled to the common pressure supply.

Preferably, the use of a heat treatment machine with sealing heads provided with actuators 6 and 8 is effected according to a control process that, from an open position of the treatment chamber, consists of temporarily closing the horizontal sealing rollers 2 and 3 around the conveyor belt, then of aligning the horizontal sealing rollers 2 and 3 by means of the seals 5, of next placing the horizontal sealing rollers 2 and 3 under pressure against the conveyor belt, of then applying the thin sealing sheets 12 of the seals 4, under pressure, to the horizontal sealing rollers 2 and 3, of then applying the seals 5, under pressure, against the ends of the horizontal sealing rollers 2 and 3, of then pressurizing the treatment chamber, subject to authorization to start up delivered by the contacts or sensors recording the closure of the different drain valves 6' to 8' and the opening of the regulating valves 6" to 8" allocated to the actuators 6 to 8, a fall in pressure in the chamber or an order to open a sealing head causing control of the regulating valves 6" to 8" to halt at the same time as the opening of the drain valve of the chamber and the issue of a signal prohibiting restarting, the control actuators 8 of the seals 5 controlling the thin sheets 12 forming the seals 4 and 6 for controlling the movement of one or both horizontal sealing rollers 2 and/or 3 being then successively depressurized in order to return to the open position of the machine before a new treatment cycle.

The temporary closure of the horizontal sealing rollers 2 and 3 round the conveyor belt is carried out simply by depressurizing the dual-effect actuators 6, in such a way that the upper roller 2 falls under its own weight until it makes contact with the conveyor belt. If the lower horizontal roller 3 is also mounted on sliding bearings, pressure should be applied to the corresponding actuators until the roller 3 makes contact with the conveyor belt.

Alignment of the horizontal sealing rollers 2 and 3 by means of the seals 5, after temporary closure of the horizontal sealing rollers 2 and 3 round the conveyor belt, is carried out preferably by a series of pressurizations and depressurizations of the actuators 8 acting on the seals 5. By such repetition of pressurization and de-pressurization of the actuators 8, the necessary slight relative movements of the rollers 2 and 3 can be carried out in order to perfectly align their end face.

With the aid of the process described above, the provision of pressure reduction detection in the treatment machine allows any untimely opening of a sealing head following the emergency stoppage thus caused to be prevented and provides a perfectly controlled process for accessing the interior of the chamber of the machine.

With the help of the invention, it is possible to produce sealing heads for machines for heat treating threads that use actuators that can serve simultaneously to displace the various moveable components and to absorb the vibrations caused during operation, it being possible for these actuators to be supplied by different fluids, under low pressure.

In addition, simply because the sealing head is produced with such actuators, it is possible to develop significant loads under low fluid pressure while taking up only a small space. In addition, since the actuators according to the invention are not provided with moveable means traversing them in the form of guided parts, they are not subject to internal sealing problems and have a low production cost.

Moreover, these actuators are extremely robust, resist aggressive environments and high temperatures, require no maintenance and can operate with angular and axial misalignment.

Finally, due to their structure, the actuators 6 to 8 do not require special guiding and can therefore be easily and rapidly mounted and removed, reassembly being carried out without complex adjustment or special tooling.

Of course, the invention is not limited to the embodiment described and illustrated in the accompanying drawings. Modifications are possible, particularly from the point of view of the composition of the various components or by substitution of technical equivalents, without thereby departing from the scope of protection of the invention.

The invention claimed is:

1. A control process for a heat treatment machine for heat treating threads, the heat treatment machine comprising at least one sealing head provided with balloon or bellows type actuators without pistons that move the heat treatment machine between an open position and a closed position, the control process comprising:

positioning an upper horizontal sealing roller and a lower horizontal sealing roller with respect to opposite faces of a conveyor belt;

aligning the horizontal sealing rollers using vertical seals adjacent ends of the upper and lower horizontal sealing rollers, wherein aligning the horizontal sealing rollers comprises performing a series of pressurizations and de-pressurizations of at least one balloon or bellows type actuator of a third set of balloon or bellows type actuators;

actuating a first set of the balloon or bellows type actuators to place the upper and lower horizontal sealing rollers under pressure against the opposite faces of the conveyor belt;

actuating a second set of the balloon or bellows type actuators to apply thin sealing sheets of horizontal seals, under pressure, to the upper and lower horizontal sealing rollers;

actuating the third set of the balloon or bellows type actuators to apply the vertical seals, under pressure, against the ends of the upper and lower horizontal sealing rollers;

providing authorization to pressurize a treatment chamber upon closing a plurality of drain valves associated with the first, second, and third sets of balloon or bellows type actuators while opening a plurality of regulating valves that control the first, second, and third sets of balloon or bellows type actuators; and successively depressurizing the third, second, and first sets of balloon or bellows type actuators to return the heat treatment machine to the open position before a new treatment cycle.

2. The control process according to claim 1, wherein positioning the upper horizontal sealing roller comprises depressurizing at least one of the balloon or bellows type actuators of the first set of balloon or bellows type actuators to allow the upper horizontal sealing roller to fall under its own weight until the upper horizontal sealing roller contacts the conveyor belt.

3. The control process according to claim 1, wherein the plurality of regulating valves comprises first, second, and third regulating valves associated with the first, second, and third sets of balloon or bellows type actuators, respectively, and wherein each of the plurality of regulating valves operates independently of each other.

4. The control process according to claim 3, further comprising supplying pressurized fluid for actuating each of the balloon or bellows type actuators by a common pressure supply, wherein each of the plurality of regulating valves is coupled to the common pressure supply.

5. The control process according to claim 1, wherein actuating a balloon or bellows type actuator includes supplying or removing pressurized fluid to or from the balloon or bellows type actuator, wherein a maximum pressure within the balloon or bellows type actuator is 8 bar.

6. The control process according to claim 5, wherein the pressurized fluid is a compressible fluid, and wherein closing the plurality of drain valves associated with the first, second, and third sets of balloon or bellows type actuators while opening the plurality of regulating valves that control the first, second, and third sets of balloon or bellows type actuators is associated with providing vibrational insulation to the sealing heads.

7. The control process according to claim 6, wherein the compressible fluid is a gas.

8. The control process according to claim 1, wherein actuating the third set of balloon or bellows type actuators to apply the vertical seals, under pressure, against the ends of the upper and lower horizontal sealing rollers further comprises amplifying forces from the third set of balloon or bellows type actuators through a set of elbow levers pivotally mounted between the third set of balloon or bellows type actuators and the vertical seals.

* * * * *